US006086520A

United States Patent [19]

Rodriquez

[11] Patent Number: 6,086,520

[45] Date of Patent: Jul. 11, 2000

[54] WEIGHT LIFTING SAFETY SYSTEM EMPLOYING CONSTANT FORCE SPRING

[76] Inventor: Anibal Rodriquez, 12751 Parkbury Dr., Orlando, Fla. 32828

[21] Appl. No.: 09/470,867

[22] Filed: Dec. 23, 1999

[51] Int. Cl.[7] ..... A63B 21/078

[52] U.S. Cl. ..... 482/104

[58] Field of Search ..... 482/94, 104, 106, 482/908

[56] References Cited

U.S. PATENT DOCUMENTS

| | | | |
|---|---|---|---|
| 4,799,672 | 1/1989 | Barrett | 482/104 |
| 5,281,193 | 1/1994 | Colbo, Jr. | 482/104 |
| 5,779,602 | 7/1998 | Rodriquez | 482/104 |

*Primary Examiner*—John Mulcahy

[57] ABSTRACT

A pair of weight supporting units are provided on opposite sides of a bench. The units are of identical construction and include: a housing; a barbell support shaft and rest extending vertically from the housing; a jack screw interconnected with the shaft; a electric motor for rotating the jack screw; and a constant force spring connected between the top of the housing and a spring platform which is threaded about the jack screw. The motor, spring platform and barbell support are vertically slidable together within the housing. A set of solenoid activated plungers holds them in a retracted position against the force of the spring. In response to a dangerous situation the user depresses an emergency pedal, causing the plungers to release the motor, spring platform and barbell support which is brought to an extended position by the force of the spring. Thereafter, the motor is activated to rotate the jack screw in a first sense causing the motor to travel downwardly to engage the plungers upon which the jack screw is rotated oppositely to bring the spring platform down against the force of the spring.

5 Claims, 4 Drawing Sheets

WEIGHT LIFTING SAFETY SYSTEM EMPLOYING CONSTANT FORCE SPRING

BACKGROUND OF THE INVENTION

1. Field of the Invention

The present invention relates to a weight lifting safety system, and more particularly pertains to a weight lifting safety system which employs a constant force spring.

2. Description of Related Art

The dangers associated with free weights are well known. After numerous repetitions, lifters often become fatigued resulting in their inability to position the barbell back on the rack. The end result is a lifter who becomes trapped beneath the weight of the barbell. This danger is avoided, traditionally, by using a spotter, one who stands over the weight lifter to give assistance in the event of trouble. Mechanical devices are also used to achieve a similar result.

For example, U.S. Pat. No. 5,281,193 to Colbo, Jr. discloses a bench-press weight workout station with certain safety features. Furthermore, U.S. Pat. No. 4,799,672 to Barrett discloses a safety device specifically for use in powerlift competitions. Russian patent 1443892 discloses a spring loaded holder for use in holding a bar while weights are being changed. Finally, the inventors prior patent, U.S. Pat. No. 5,779,602, discloses a system for raising weights in response to a dangerous situation. The contents of U.S. Pat. No. 5,779,602 are incorporated herein by reference.

Although each of these prior devices achieves it's own particular objective, none of them results in a device which, in response to a dangerous situation, lifts a barbell in a smooth and controlled manner. The safety system of the present invention achieves this objective.

BRIEF SUMMARY OF THE INVENTION

The general purpose of the present invention is to provide a weight lifting safety system that, in response to a dangerous situation, raises a barbell in a smooth and controlled manner.

To attain this, the present invention essentially comprises an improved weight lifting safety system including a control means situated adjacent to the weight lifting system. The system further includes a weight supporting unit having an outer housing and a barbell support shaft slidably positioned within the housing. An acme jack rod screw is interconnected with the barbell support shaft. Furthermore, motive means are included which are capable of rotating the acme jack screw. The motive means are interconnected at a lower end of the acme jack screw. A motor support platform serves to support the motor. This platform is slidably positioned within the interior of the housing. An activation button is included for use in rotating the screw in one of two senses. The system employs a spring having an upper portion secured to the upper extent of the housing. A spring platform is threadably secured along the length of the screw, and a lower portion of the spring is secured to the spring platform. Containment means are removably interconnected to the motor platform. The control means are employed to deactivate the containment means. Deactivating the containment means results in the motor platform, spring platform, and barbell support shaft extending upwardly under the power of the spring. Thereafter, rotation of the screw in a first sense causes the motor platform to travel downwardly and engage the containment means, and rotation of the screw in the second opposite sense causes the spring platform to extend downwardly against the force of the springs.

It is therefore an object of the present invention to provide a system for enabling a weight lifter to raise a set of weight in response to a dangerous situation.

It is another object of the present invention to provide a system which employs a constant force spring to raise a set of weights in a smooth and controlled manner.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DETAILED DESCRIPTION OF THE INVENTION

The present invention relates to a safety system specifically for use in conjunction with weight lifting. The invention finds particular application in conjunction with barbells and a weight lifting bench. Through the use of the present system, the need for someone to supervise and protect the weight lifter, eg. a spotter, is eliminated. A weight lifter can selectively employ a control means to shield themselves from the weight of the barbells. The preferred embodiment of the system is described below in conjunction with FIGS. 1–7.

Figure 1:
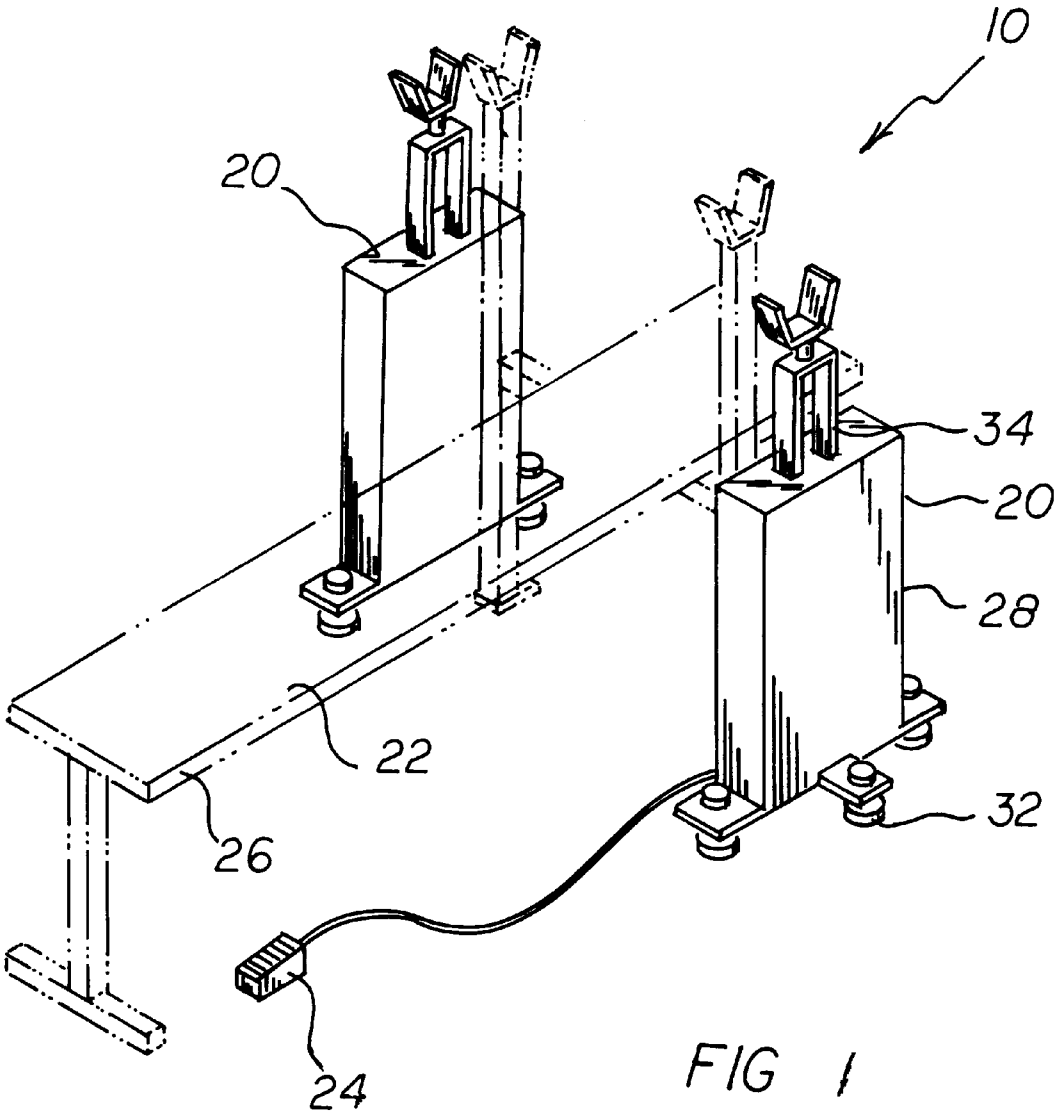
FIG. 1 is a perspective view of the weight lifting system of the present invention.

With reference to FIG. 1, one application 10 of the present invention is depicted. This application employs weight supporting units 20, a bench 22 and an emergency pedal 24 positioned adjacent the forward end 26 of the bench 22. Thus, FIG. 1, illustrates the weight lifting configuration 10 commonly employed for bench press exercises. The present invention, however, can also be employed in conjunction with other exercises, such as the inclined bench presses, the butterfly press, and leg lifting exercises.

With continuing reference to FIG. 1, the first and second weight supporting units 20 are depicted. Each of these weight supporting units are of an identical construction, thus only one will be described in detail.

Figure 3:
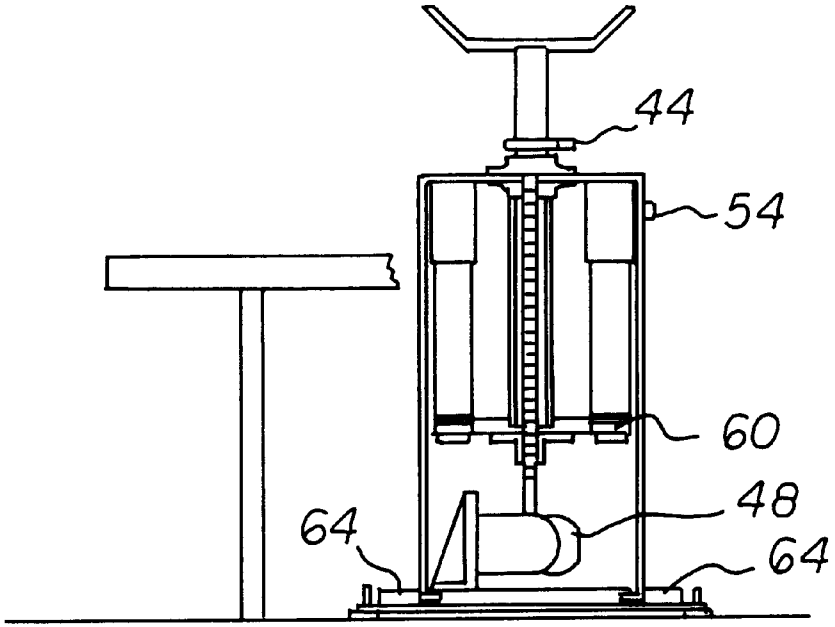
FIG. 3 is a side elevational view of one supporting unit in the non extended orientation with the barbell support at an adjusted elevation.
Figure 2:
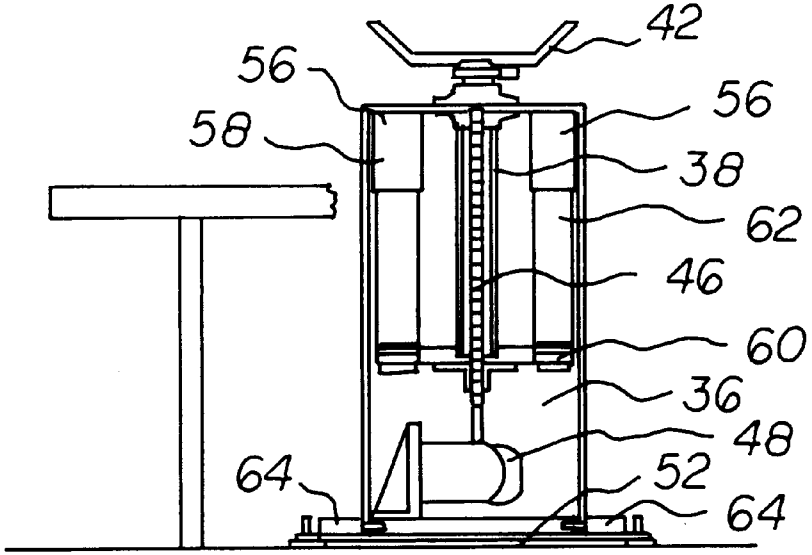
FIG. 2 is a side elevational view of one supporting unit in the non extended orientation.
Figure 5:
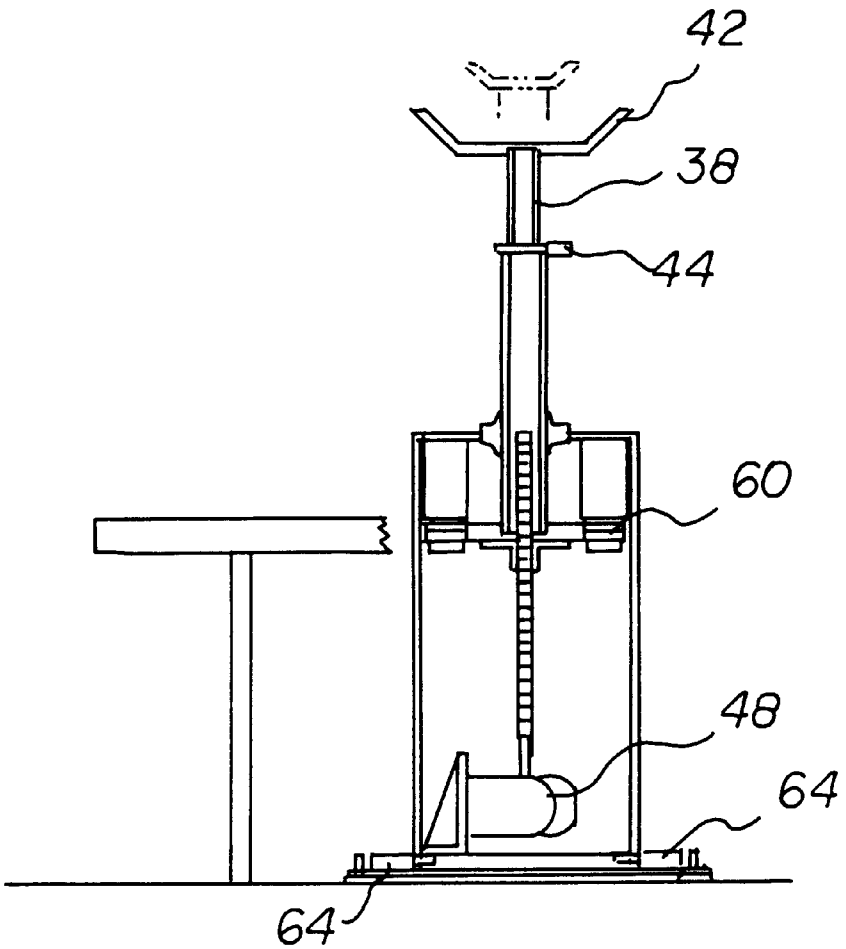
FIG. 5 is a side elevational view of one supporting unit with the motor platform returned.
Figure 4:
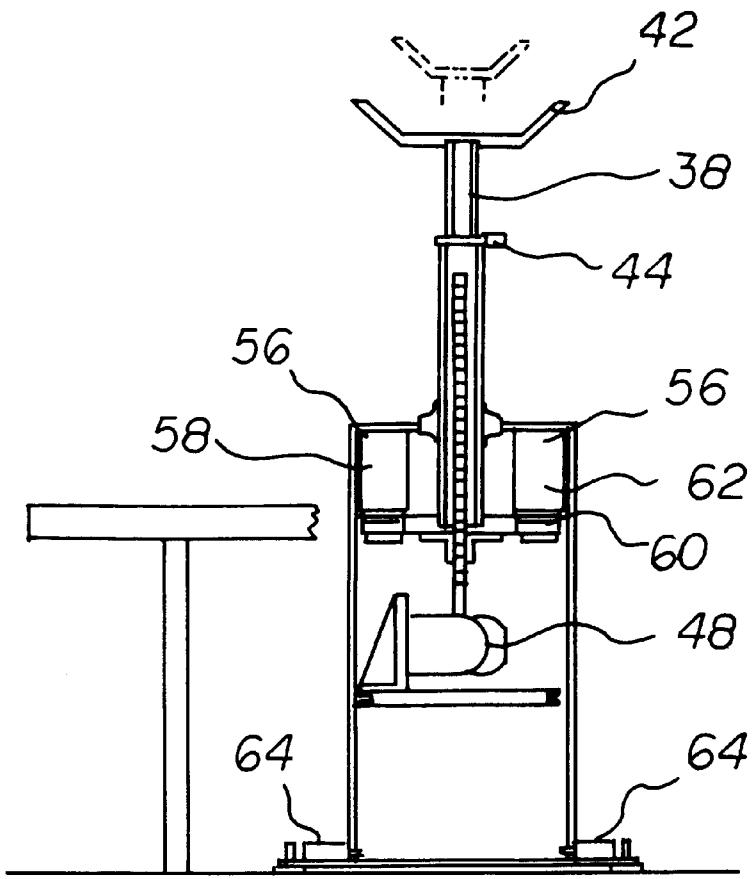
FIG. 4 is a side elevational view of one supporting unit in the extended orientation.
Figure 7:
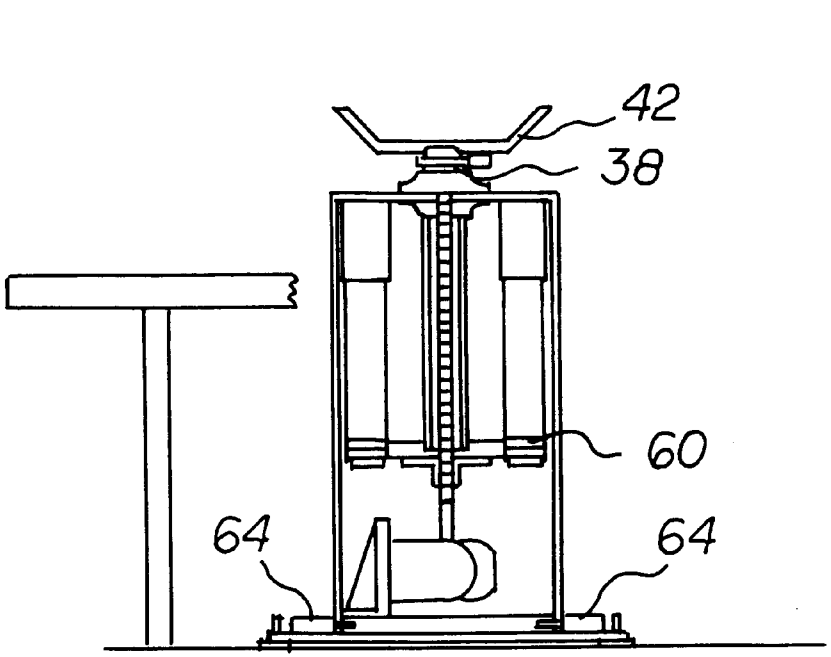
FIG. 7 is a side elevational view of one supporting unit in the non extended orientation.
Figure 6:
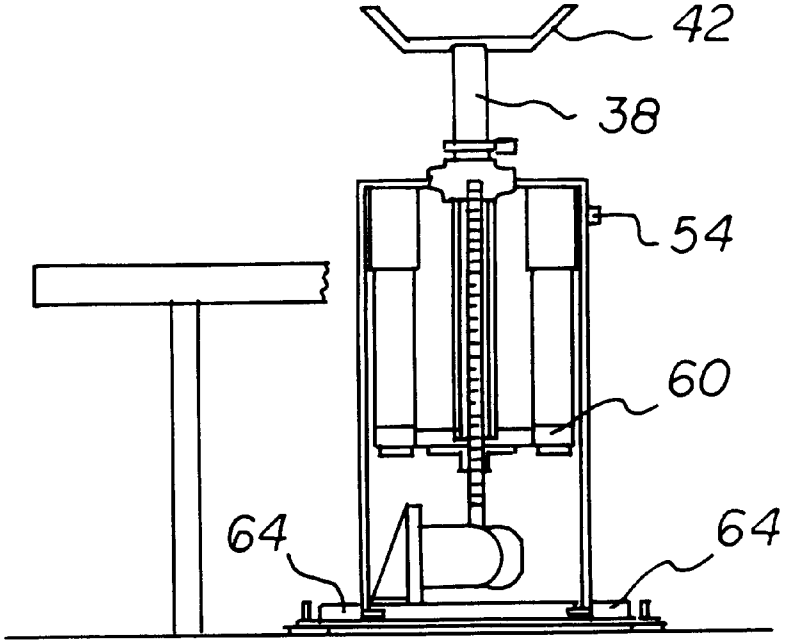
FIG. 6 is a side elevational view of one supporting unit in the non extended orientation.

The supporting unit 20 includes an outer housing 28 that is defined by a lower extent 32, an upper extent 34 and a hollow interior 36. Furthermore, a barbell support shaft 38 and rest 42 are slidably positioned within the upper extent 34 of the housing 28. The rest 42 ideally takes the form of a widened V shape and is employed in supporting one end of a barbell. The support shaft 38 and rest are slidably interconnected, with the interconnection being achieved through an adjustment pin 44. This pin 44 enables the system to accommodate the arm span of differing users. FIGS. 2 and 3 illustrate two possible adjustments between the support shaft 38 and rest 42.

The FIGS. 2–7 are detailed sectional views illustrating the working components of the supporting unit 20. One such internal component is the lifting screw 46. In the preferred embodiment, this lifting screw 46 takes the form of an acme jack screw. With continuing reference to FIGS. 2–7, the screw 46 is interconnected with interior of the barbell support shaft 38. This interconnection can be achieved in any manner known in the art, however, it should be a fixed connection such as to disallow movement between the support shaft and screw. The opposite end of the screw is interconnected to a motive means. In the preferred embodiment, this motive means takes the form of an electric motor 48. Whatever motive means is employed, it should be capable of rotating the interconnected acme jack screw 46.

A motor support platform 52 is also positioned within the weight supporting unit 20. The support platform 52 carries the associated electric motor. Furthermore, as is evident from the Figures, the support platform 52 is slidably positioned within the interior of the housing 28. The motor 48 also includes an activation button 54, which is electrically coupled to the motor 48, for use in rotating the acme jack screw 46 in one of two senses. This activation button 54 is ideally positioned upon the supporting unit for easy access by a user of the system.

The springs 56 employed by the system will next be described. In the preferred embodiment, a constant force spring is positioned within the housing 28 intermediate the upper end 34 of the housing 28 and motor platform 52. Ideally, the spring 56 is formed from first and second legs, 58 and 62, that are positioned on either side of the acme jack screw 46. Thus, the upper portions of the first and second legs are secured to the upper extent 34 of the housing 28 and the lower portions of the first and second legs are secured to a spring platform 60. This spring platform 60 is threadably secured along the length of the acme jack screw 46. The manner in which the constant force spring operates in the system will be described in greater detail hereinafter.

The system of the present invention also employs a containment system for selectively restraining the sliding movement of the motor platform. Preferably, this containment system takes the form of a set of solenoid activated plungers 64 that are removably interconnected to the motor platform 52. These plungers 64 can be activated by the emergency pedal 24.

Thus, in operation, depressing the emergency pedal causes the plungers to retract from the motor platform which, in turn, causes the motor platform, spring platform, and barbell support shaft to extend upwardly under the power of the constant force spring. In this manner a user can prevent a barbell from falling onto their chest during exercise repetitions. After the system has been released, the activation button is employed to bring the system back to its original configuration. Specifically, depressing the activation a first time causes rotation of the acme jack screw in a first sense. This, in turn, causes the motor platform to travel downwardly and engage the plungers, note FIG. 4. Once it engages the plungers and it makes contact with the limit switches it does the rotation of the acme jack screw in the second opposite sense automatically. This, in turn, causes the spring platform to extend downwardly against the force of the springs, note FIG. 5.

Thus, FIGS. 3–6 illustrate one complete cycle of operation. Specifically, FIG. 3 illustrates the support unit in the non extended orientation. Thereafter, in response to a dangerous situation, the motor support platform is released and the entire internal assembly is raised powered by the constant force springs. The constant force springs, however, due to their nature, are raised in a smooth and controlled manner. As a result, there is not violent collision when the rest and support shaft engage the barbell. Thereafter, rotation of the acme jack screw results in the motor platform being brought down, note FIG. 5. Rotation of the acme jack screw in an opposite sense results in the spring platform being brought down.

This detailed description has been provided only for illustrative purposes. It is recognized that other embodiments may be articulated without departing from the objects and scope of the present invention. Any such modifications and variations are meant to be within the scope of the invention as contained within the following claims.

What is claimed as being new and desired to be protected by Letters Patent of the United States is as follows:

1. A improved weight lifting safety system employing a constant force spring, the system comprising in combination:

a bench having a forward end and a rearward end, an emergency pedal positioned adjacent the forward end;

first and second weight supporting units, each of the weight supporting units being of an identical construction and including;

an outer housing having a lower extent, an upper extent and a hollow interior;

a barbell support shaft and rest slidably positioned within the upper extent of the housing;

a jack screw interconnected with the barbell support shaft, an electric motor capable of rotating the jack screw interconnected at a lower end of the jack screw;

a motor support platform supporting the electric motor and slidably positioned within the interior of the housing, an activation button for use in rotating the jack screw in one of two senses;

a constant force spring formed from first and second legs positioned on either side of the jack screw, the upper portions of the first and second legs being secured to the upper extent of the housing;

a spring platform being threadably secured along the length of the jack screw, the lower portions of the first and second legs being secured to the spring platform;

a set of solenoid activated plungers being removably interconnected to the motor platform, the emergency pedal being employed to activate the set of solenoid activated plungers;

depressing the emergency pedal causing the plungers to retract from the motor platform and causing the motor platform, spring platform, and barbell support shaft to extend upwardly under the power of the constant force spring, thereafter rotation of the jack screw in a first sense causing the motor platform to travel downwardly and engage the plungers, rotation of the jack screw in the second opposite sense causing the spring platform to extend downwardly against the force of the springs.

2. A improved weight lifting safety system comprising:

control means situated adjacent the weight lifting system;

a weight supporting unit including an outer housing and a barbell support shaft slidably positioned within the housing;

a jack screw interconnected with the barbell support shaft;

motive means capable of rotating the jack screw interconnected at a lower end of the jack screw;

a motor support platform supporting the motor and slidable positioned within the interior of the housing, an activation button for use in rotating the screw in one of two senses;

a spring having an upper portion secured to the upper extent of the housing;

a spring platform being threadably secured along the length of the screw, a lower portion of the spring being secured to the spring platform;

containment means removably interconnected to the motor platform, the control means being employed to deactivate the containment means;

deactivating the containment means thus causing the motor platform, spring platform, and barbell support shaft to extend upwardly under the power of the spring, thereafter rotation of the screw in a first sense causing the motor platform to travel downwardly and engage the containment means, rotation of the screw in the second opposite sense causing the spring platform to extend downwardly against the force of the springs.

3. The system as described in claim 2 wherein the spring is a constant force spring.

4. The system as described in claim 2 wherein the control means is an activation pedal.

5. The system as described in claim 2 wherein the containment means is a solenoid activated plunger.

* * * * *